US009896868B2

(12) United States Patent
Zhang et al.

(10) Patent No.: US 9,896,868 B2
(45) Date of Patent: Feb. 20, 2018

(54) VEHICLE HINGE ASSEMBLY AND METHOD OF OPERATING THE SAME

(71) Applicant: FORD GLOBAL TECHNOLOGIES, LLC, Dearborn, MI (US)

(72) Inventors: Pengfei Zhang, Nanjing (CN); Yufa Fu, Nanjing (CN); Kaiding Zhang, Nanjing (CN); Wei Xu, Nanjing (CN)

(73) Assignee: Ford Global Technologies, LLC, Dearborn, MI (US)

( * ) Notice: Subject to any disclaimer, the term of this patent is extended or adjusted under 35 U.S.C. 154(b) by 50 days.

(21) Appl. No.: 15/053,810

(22) Filed: Feb. 25, 2016

(65) Prior Publication Data

US 2016/0251036 A1 Sep. 1, 2016

(30) Foreign Application Priority Data

Feb. 28, 2015 (CN) ..... 2015 1 0091905

(51) Int. Cl.

*E05D 5/00* (2006.01)
*E05D 11/00* (2006.01)
*E05D 5/02* (2006.01)

(52) U.S. Cl.

CPC ..... *E05D 5/00* (2013.01); *E05D 5/0207* (2013.01); *E05D 11/00* (2013.01); *E05Y 2900/548* (2013.01)

(58) Field of Classification Search

CPC ..... E05D 5/00; E05D 5/0207; E05D 11/0054; E05D 2011/0072; E05D 11/00; E05Y 2900/548; B60R 16/0222

USPC ..... 16/2.1, 250, 254, 261, 270, 272, 378

See application file for complete search history.

(56) References Cited

U.S. PATENT DOCUMENTS 2,170,718 A * 8/1939 Humphries ..... G05G 1/02 16/2.1
2,632,479 A * 3/1953 Pfeil ..... B65D 59/00 138/96 T
3,643,290 A * 2/1972 Milne ..... F16L 41/08 16/2.1
4,535,196 A * 8/1985 Milne ..... H02G 3/0683 16/2.1
5,366,476 A 11/1994 Noda
5,706,556 A * 1/1998 Kluting ..... E05D 5/10 16/260
6,090,120 A 7/2000 Wright
8,156,611 B2 * 4/2012 MacHin ..... E05D 7/121 16/254
8,839,486 B2 * 9/2014 Diehl ..... B21J 15/025 16/2.1
2003/0060732 A1 3/2003 Jacobsen
2003/0079311 A1 * 5/2003 Yamamoto ..... B60G 99/004 16/2.1
2004/0205934 A1 * 10/2004 Derbis ..... E05D 3/145 16/289

(Continued)

*Primary Examiner* — Roberta S Delisle
(74) *Attorney, Agent, or Firm* — Vichit Chea; Brooks Kushman, P.C.

(57) ABSTRACT

In one or more embodiments, a hinge assembly is provided to a vehicle including first and second parts with the first part including a hinge aperture, where the hinge assembly includes a hinge arm to be connected to the second part and partially received through the hinge aperture, and a hinge skirt including a skirt aperture to partially receive the hinge arm, the hinge skirt to be positioned between the first and second parts.

10 Claims, 3 Drawing Sheets

(56) References Cited

U.S. PATENT DOCUMENTS

| | | | | |
|---|---|---|---|---|
| 2006/0071503 | A1* | 4/2006 | Miyake | E05F 15/63 296/146.4 |
| 2012/0240350 | A1* | 9/2012 | Natu | E05D 11/0081 16/2.2 |
| 2013/0042464 | A1* | 2/2013 | Orcutt | B23P 6/00 29/525.11 |
| 2013/0061423 | A1* | 3/2013 | Ahern | F16C 43/02 16/2.1 |
| 2013/0111703 | A1* | 5/2013 | Duffy | E05D 7/04 16/221 |
| 2015/0282611 | A1* | 10/2015 | Herring | H02G 3/22 29/505 |

* cited by examiner

VEHICLE HINGE ASSEMBLY AND METHOD OF OPERATING THE SAME

CROSS-REFERENCE TO RELATED APPLICATIONS

This application claims foreign priority benefits under 35 U.S.C. § 119(a)-(d) to CN 2015 100 919 05.9 filed Feb. 28, 2015, which is hereby incorporated by reference in its entirety.

TECHNICAL FIELD

The present disclosure relates to a vehicle hinge assembly and a method of operating the same.

BACKGROUND

Modern vehicles often include a number of parts movably connected with each other. For instance, a vehicle may at its rear end include a trunk, which may be accessed via a trunk opening. A deck lid is mounted at the trunk opening via a hinge assembly. The hinge assembly enables the deck lid to transit between an open position in which the trunk may be accessible and a closed position in which the deck lid covers the trunk opening to protect and retain luggage in the trunk. For assembly, a hinge arm of the hinge assembly may need to extend through a hinge aperture formed on a trunk trim panel.

U.S. Patent publication US 2012/0205937 A1 discloses a hinge assembly which enables the deck lid to transit between an open position and a closed position.

SUMMARY

According to one or more embodiments, there provides a hinge assembly of a vehicle including first and second parts with the first part including a hinge aperture, where the hinge assembly includes a hinge arm to be connected to the second part and partially received through the hinge aperture; and a hinge skirt including a skirt aperture to partially receive the hinge arm, the hinge skirt to be positioned between the first and second parts.

The hinge skirt may define a first portion extending in a first direction and a second portion extending in a second direction different from the first direction.

The hinge assembly may further comprise a cushion positioned between the second portion and the hinge arm.

The cushion may differ in material from the second portion.

The cushion may contact the hinge arm.

The second portion may be at least partially spaced apart from the hinge aperture.

The hinge assembly may further comprises a stabilizer to contact the hinge skirt when the second part moves to a closed position relative to the first part.

The stabilizer may include two spaced-apart sections with a portion of the hinge arm positioned there-between.

The hinge skirt may include a side slit via which the hinge skirt is detachable from the hinge arm.

According to another one or more embodiments, a hinged vehicle part assembly includes a first part including a hinge aperture; a second part movable relative to the first part; a hinge arm connected to the second part and being partially received through the hinge aperture, and a hinge skirt including a skirt aperture to partially receive the hinge arm, the hinge skirt being positioned between the first and second parts.

The hinge skirt may contact an exterior surface of the first part.

The hinged vehicle part assembly may further include a stabilizer connected to the second part, the stabilizer to contact the hinge skirt when the second part moves to a close position relative to the first vehicle part.

According to another one or more embodiments, a method of operating a hinge assembly of a vehicle including first and second parts with the first part including a hinge aperture is disclosed. The hinge assembly includes a hinge arm connected to the second part and partially received through the hinge aperture. The method includes positioning a hinge skirt to be between the first and second parts, the hinge skirt including a skirt aperture; and The method may further include removing the hinge skirt from the vehicle; and positioning a second hinge skirt to be between the first and second parts.

The step of removing the hinge skirt may be carried out by creating a slit on the hinge skirt.

One or more advantageous features as described herein are believed to be readily apparent from the following detailed description of one or more embodiments when taken in connection with the accompanying drawings.

BRIEF DESCRIPTION OF THE DRAWINGS

For a more complete understanding of one or more embodiments of the present invention, reference is now made to the one or more embodiments illustrated in greater detail in the accompanying drawings and described below wherein.

DETAILED DESCRIPTION

Figure 1:
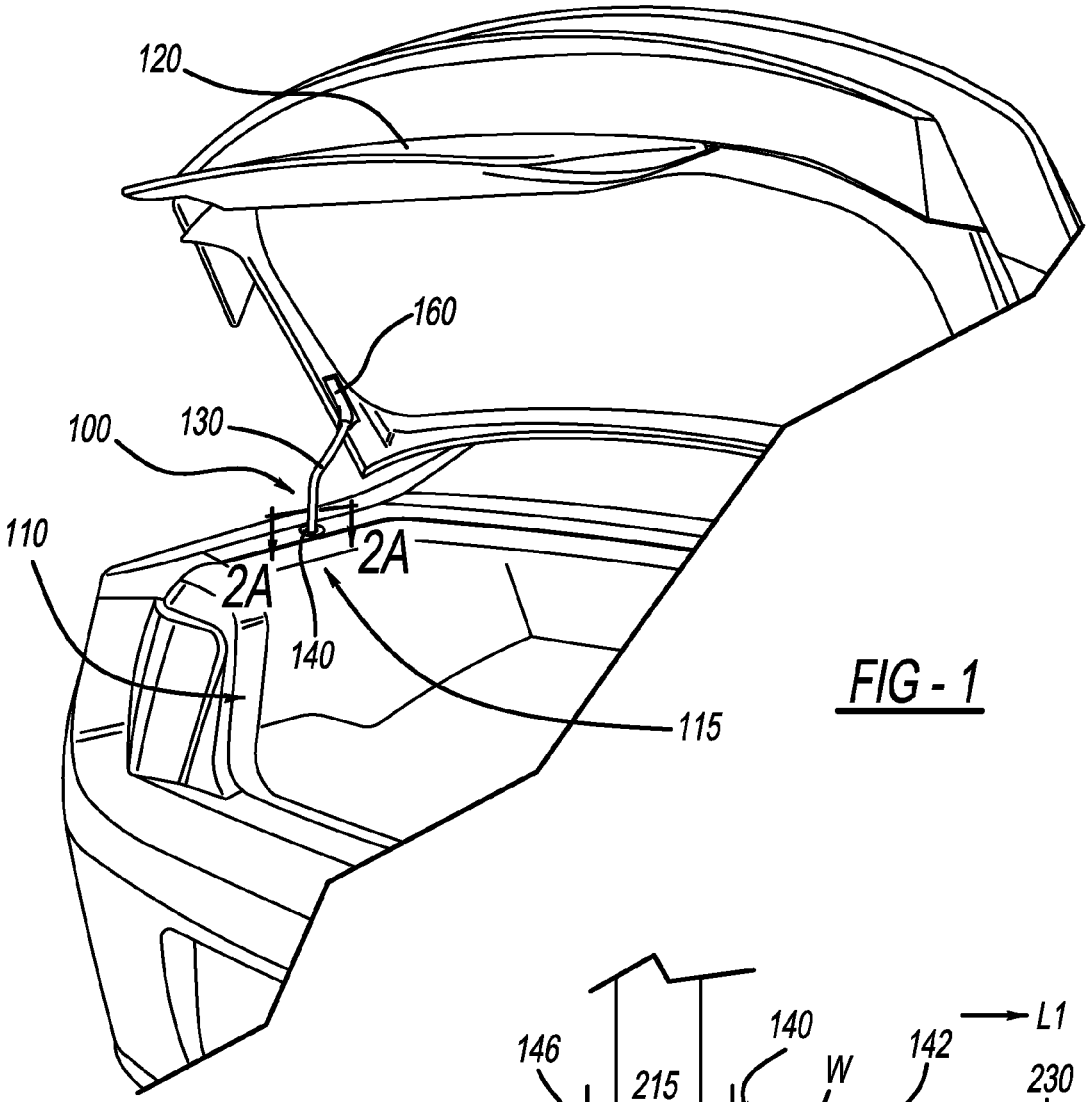
FIG. 1 illustratively depicts a hinge assembly according to one or more embodiments of the present disclosure.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As referenced in the Figures, the same reference numerals may be used herein to refer to the same parameters and components or their similar modifications and alternatives. These parameters and components are included as examples and are not meant to be limiting. The drawings referenced herein are schematic and associated views thereof are not necessarily drawn to scale.

As is detailed herein elsewhere, the present disclosure in one or more embodiments is advantageous at least in providing a hinge assembly of a vehicle, via which two parts of the vehicle may be connected to each other with relatively enhanced ease and greater visual appeal.

Figure 2A:
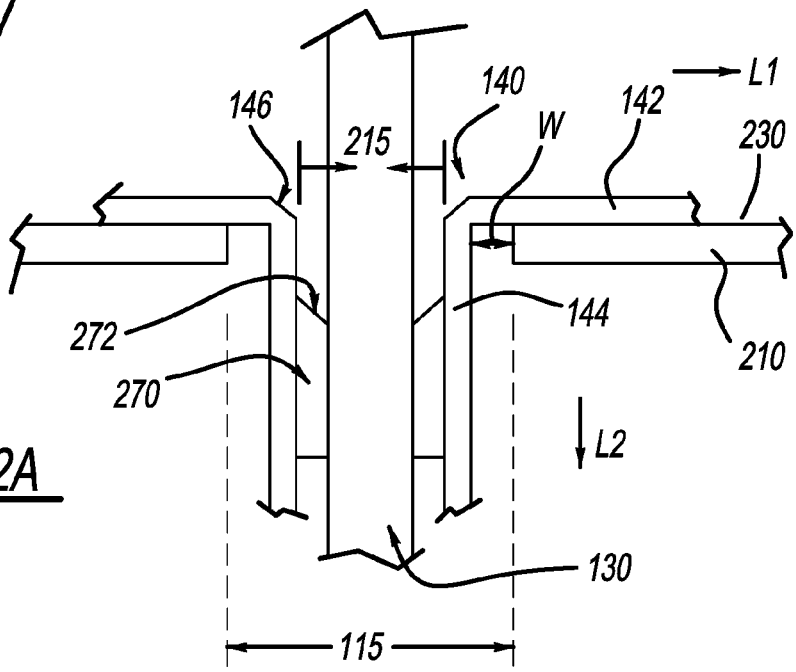
FIG. 2A illustratively depicts a cross-sectional view of the hinge assembly referenced in FIG. 1, taken along line 2A-2A.

FIG. 1 and FIG. 2A illustratively depict a hinge assembly 100 of a vehicle including a first part 110 and a second parts 120. For purpose of illustration, the first part 110 is shown as a portion of the trunk of the vehicle, and the second part 120 is shown as a portion of the deck lid. In other embodiments, the first and second parts 110, 120 may be positioned at other locations as needed.

The first part 110 includes a hinge aperture 115. The hinge assembly 100 includes a hinge arm 130 to be connected to the second part 120 and partially received through the hinge aperture 115. The hinge assembly 100 further includes a hinge skirt 140 including a skirt aperture 215 to partially receive there-through the hinge arm 130. The hinge skirt 140 is positioned between the first and second parts 110, 120.

Advantageously, the hinge skirt 140 may be provided and positioned to be slidable relative to the hinge arm 130 in a longitudinal direction, such as a direction "L2" depicted in FIG. 2A. This structure is believed to be particularly advantageous when connecting two parts of the vehicle, in that the hinge skirt 140 may sit on the hinge aperture 115 of the first part 110 under gravity when the second part 120 is opened relative to the first part 110 thereby avoiding vehicle structural or harness parts become unpleasantly visible through the hinge aperture 115. Meanwhile, the hinge skirt 140 may be arranged to be movable relative to the first part 110 along a lateral direction, such as in direction "L1" depicted in FIG. 2A. This structure is believed to be particularly advantageous for the cooperative interaction between the hinge arm 130 and the hinge aperture 115, in that lateral movement of the hinge skirt 140 relative to the hinge aperture 115 may be permissible to avoid unwanted interference between the first and second parts 110, 120 during opening or closing the second part 120, where the unwanted interference may be due to any possible manufacturing and/or installation errors, and accordingly user experience may be improved. Accordingly, the employment in the hinge assembly 100 of the hinge skirt 140 provides synergy in substantiating design and/or operation freedom for the hinge arm 130 and visual feel maintenance and even visual enhancement associated with such freedom.

For purpose of illustration, the hinge arm 130 is shown in FIG. 1 as being attached to the second part 120 via a sleeve 160. This is advantageous for the connection between the hinge arm 130 and the second part 120. In other embodiments, the hinge arm 130 may be connected at one end to the second part 120 via any suitable methods such as welding and adhesion. The other end of the hinge arm 130 may be connected movably to the first part 110 optionally via a hinge. Accordingly, the first and second parts 110, 120 may move relative to each other via the hinge arm 130. It is to be appreciated that the hinge arm 130 may be fixedly connected to the first part 110 and movably connected to the second part 120, or may be movably connected to both the first and second parts 110, 120.

As depicted in FIG. 2A, the hinge aperture 115 is formed in the first part 110. The hinge aperture 115 may be of any suitable shape in cross-section as needed, such as a circle, an oval and a rectangle. Furthermore, the hinge aperture 115 may be of a cross-section to match that of the hinge arm 130 or the hinge skirt 140 as detailed herein elsewhere. The hinge arm 130 is partially received through the hinge aperture 115. In particular, at least a portion of the hinge arm 130 may extend through the hinge aperture 115. The hinge arm 130 may be further shaped such that the hinge arm 130 may move through the hinge aperture 115 without unwanted interference during the movement of the first part 110 relative to the second part 120. Thus, other structures below the hinge aperture 115 such as metal sheets or harness components are not to be readily visible, while the operation of the hinge assembly 100 may not be negatively affected.

In certain embodiments, and as illustratively depicted in FIG. 2A, a skirt entry surface 146 of the hinge skirt 140 may be slanted to provide relatively enhanced ease for the hinge arm 130 to move within the skirt aperture 215. By being slanted, the skirt entry surface 146 is at an angle relative to the direction "L1" and/or "L2."

However, due to certain unavoidable errors associated with the manufacture and assembly of the hinge assembly 100, friction may result between the hinge arm 130 and the hinge aperture 115, and therefore noises and undesirable operation may follow, causing unfavorable user experience. Therefore, the cross-sectional size of the hinge aperture 115 is to be made greater than that of the hinge arm 130 to reduce the operational friction and hence noise. In other words, a clearance is provided between the hinge aperture 115 and the hinge arm 130 to accommodate the occurrence of unwanted errors thus associated with the manufacture and assembly. However, body structures such as metal sheets and harness components may become undesirably visible through the clearance between the hinge aperture 115 and the hinge arm 130, causing unfavorable visual experience. The hinge skirt 140 positioned between the first part 110 and the second part 120 is believed to be advantageously employed to solve this problem according to one or more embodiments of the present disclosure.

In particular, the hinge skirt 140 may be positioned at least in part above the first part 110 and below the second part 120. By way of example, a first portion 142 of the hinge skirt 140 is between the first and second parts 110, 120, although a second portion 144 may be received within the first part 110. It is to be appreciated that the hinge skirt 140 may be of any other suitable position relative to the first and second parts 110, 120 as needed.

As illustratively depicted in FIG. 2A, the hinge skirt 140 may include or define the skirt aperture 215, which partially receives the hinge arm 130. In other words, the hinge arm 130 may extend through the skirt aperture 215. Similarly, the hinge arm 130 and/or the skirt aperture 215 may be shaped such that the hinge arm 130 may move through the skirt aperture 215 without unwanted interference during the movement of the first part 110 relative to the second part 120.

Figure 2B:
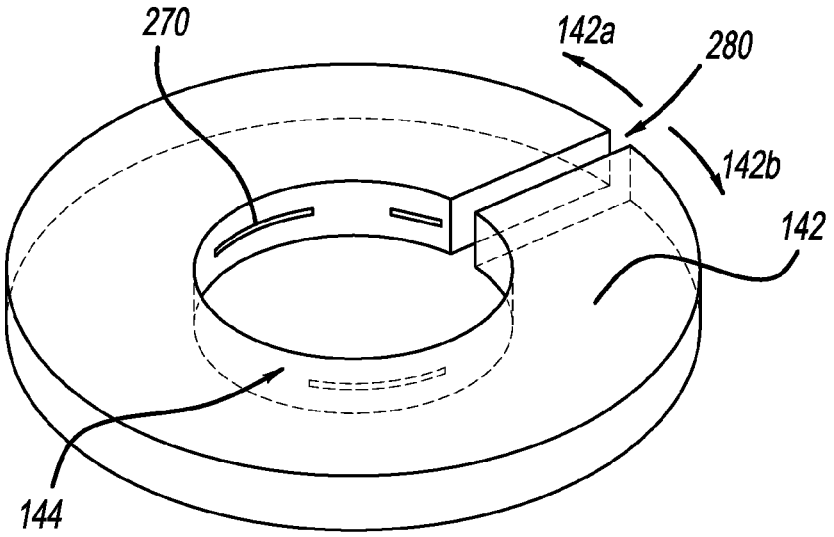
FIG. 2B illustratively depicts a perspective view of a hinge skirt of the hinge assembly referenced in FIG. 2A.

Referring to FIGS. 2A and 2B, the hinge skirt 140 may include a first portion 142 and a second portion 144. The first portion 142 may extend along the first direction "L1" or along an upper surface or an exterior surface 210 of the first part 110, and the second portion 144 may extend along the second direction "L2" or along a direction of an angle relative to the exterior surface 210 of the first part 110. Although the first direction "L1" is shown as perpendicular to the second direction "L2", it is to be appreciated that the first direction "L1" and the second direction "L2" may be of any other suitable angle relative to each other. The first portion 142 may be greater in cross-sectional size than the hinge aperture 115, such that the first portion 142 may sit on the exterior surface 210 of the first part 110 without being received through the hinge aperture 115. In this way, the hinge skirt 140 may cover the hinge aperture 115 to avoid other structures below the hinge aperture 115 being watched as detailed herein elsewhere.

Referring back to FIG. 2A, the hinge assembly may further include a cushion 270 positioned between the second portion 144 and the hinge arm 130. The cushion 270 may be attached to an inner wall of the second portion 144 via any suitable method, such as adhesion. Furthermore, the cushion 270 may differ in material from the second portion 144. For instance, the second portion 144 may include a plastic or metal to provide structural strength, and the cushion 270 may include a low coefficient of friction material such as a polyester tape. Accordingly, the hinge arm 130 may contact the cushion 270 after entry into the skirt aperture 215, incurring relatively low friction force between the cushion 270 and the hinge arm 130, and thus facilitating a desirable operation of the hinge assembly 100 without unfavorable user experience. Furthermore, and due to the relatively low friction force between the cushion 270 and the hinge arm 130, the hinge skirt 140 may by default always sit on the hinge aperture 115 under gravity and provides covering against unwanted underbody structures. It is to be appreciated that in certain other embodiments the cushion 270 and the second portion 144 may be of the same material.

In certain other embodiments, and when the cushion 270 is employed, a cushion entry surface 272 may be also slanted to provide additional ease for the hinge arm 130 to move within the hinge aperture 115. By being slanted, the cushion entry surface 272 is at an angle relative to the direction "L1" and/or "L2."

Referring back to FIG. 2A, the second portion 144 may at least be partially spaced apart from the hinge aperture 115. As illustratively depicted, there may be a clearance "W" between the hinge aperture 115 and the second portion 144. Due to the existence of the clearance "W", the hinge skirt 140 may move along the exterior surface 210 of the first part 110 relative to the first part 110 or the hinge aperture 115. The clearance "W" may be of any suitable size. In one or more embodiments, the size of the clearance "W" may be greater than 1 millimeter (mm), 2 mm, or 3 mm. Although the hinge skirt 140 may move along the direction "L1" relative to the second portion 144 as illustratively depicted in FIG. 2A, it is to be appreciated that the hinge skirt 140 may move in another direction such as a direction perpendicular or of another angle relative to the paper upon which FIG. 2A is presented. With this structure, if any tolerance error occurs during the manufacture and assembly of the hinge assembly 100, the hinge arm 130 may contact the second portion 144 during movement, and then the hinge skirt 140 may move relative to the hinge aperture 115 or the first part 110. Thus, any friction between the hinge arm 130 and the hinge aperture 115 that tends to be fixed in position may be reduced or eliminated, and associated noises may accordingly be reduced or eliminated. Meanwhile, due to the relatively low frictional coefficient of the cushion 270, the hinge skirt 140 may sit on the exterior surface of the first part 110 under gravity and cover the hinge aperture 115 without having to move along direction "L2" together with the hinge arm 130.

Referring back to FIG. 2B, and in one or more embodiments, the hinge skirt 140 may include a side slit 280. The hinge skirt 140 may include or be formed of an elastic material. Accordingly, side walls 142*a*, 142*b* of the side slit 280 may be spaced apart and separated from each other. When the hinge skirt 140 is to be attached or detached, the hinge skirt 140 may be attached onto or detached from the hinge arm 130 via the side slit 280.

Figure 3A:
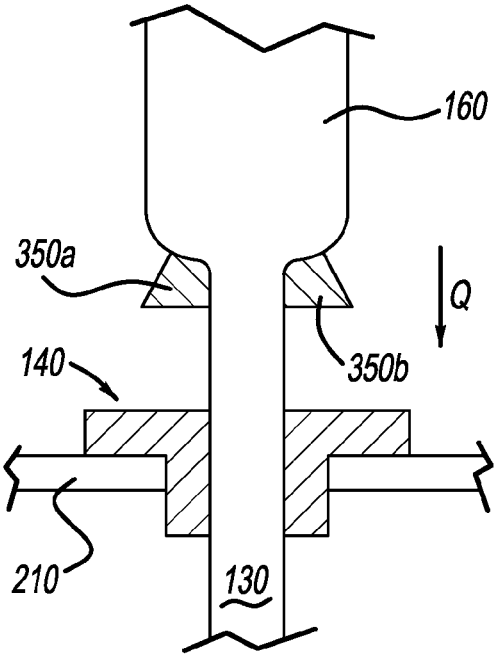
FIG. 3A illustratively depicts an alternative cross-sectional view of the hinge assembly referenced in FIG. 1, where a second part is in an open position relative to a first part.
Figure 3B:
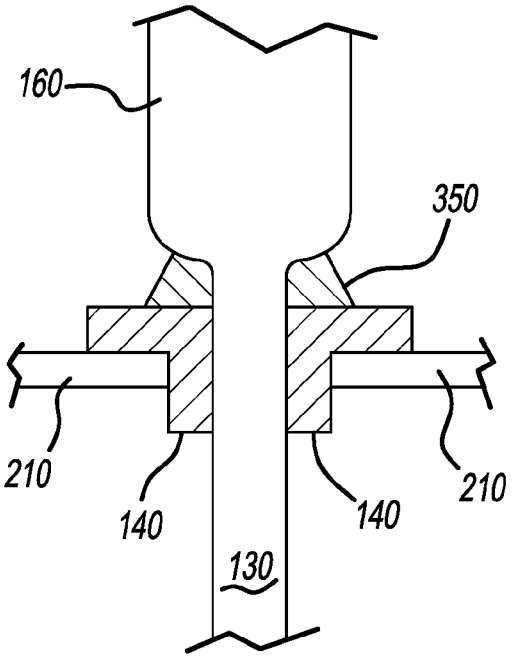
FIG. 3B illustratively depicts another cross-sectional view of the hinge assembly referenced in FIG. 3A, wherein the second part is in a closed position relative to the first part.

As illustratively depicted in FIG. 3A and 3B, and in one or more embodiments, the hinge assembly 100 may further include a stabilizer 350. The stabilizer 350 is to act both as a spacer and a stabilizing cushion between the first and second parts 110, 120. The stabilizer 350 may be of any suitable material and any suitable shape. In certain embodiments, the stabilizer 350 may include or be formed of a polymer material such as rubber. The stabilizer 350 may be a single part attached to the hinge assembly 100 via bonding, welding, or any other suitable attachment method. It is to be appreciated that the stabilizer 350 may be formed integral to the hinge arm 130 and/or the hinge sleeve 160 as needed. When the second part 120 moves to a closed position relative to the first part 100 as illustratively depicted in FIG. 3B, the stabilizer 350 may contact the hinge skirt 140, and in particular the upper surface of the hinge skirt 140. Accordingly, the hinge skirt 140 may be sandwiched between the first part 110 and the second part 120, thereby reducing vibrations and associated noises.

The stabilizer 350 may be of variable configurations. In one or more embodiments, the stabilizer 350 may include two or more sections positioned spaced apart with an angle between any two of the sections. By way of example and as depicted in FIG. 3A, the stabilizer 350 may include two section 350*a*, 350*b* spaced apart with each other, and a portion of the hinge arm 130 may be positioned between these two sections. Accordingly, the stabilizer 350 may exert a relatively uniform clamping force to the hinge skirt 140. In another or more embodiments, the stabilizer 350 may be positioned about or may wrap around the hinge arm 130 continuously. In such instances, the stabilizer 350 may be configured as a close-loop ring or an open-loop ring to receive there through a portion of the hinge arm 130. In certain embodiments, the stabilizer 350 may be of a single section for purpose of cost-saving. Moreover, the stabilizer 350 may be formed as part of the second part 120 or the hinge sleeve 160. In other words, when the second part 120 is in a closed position, the second part 120 or the hinge sleeve 160 may contact the hinge skirt 140 directly to provide clamping force.

Figure 4:
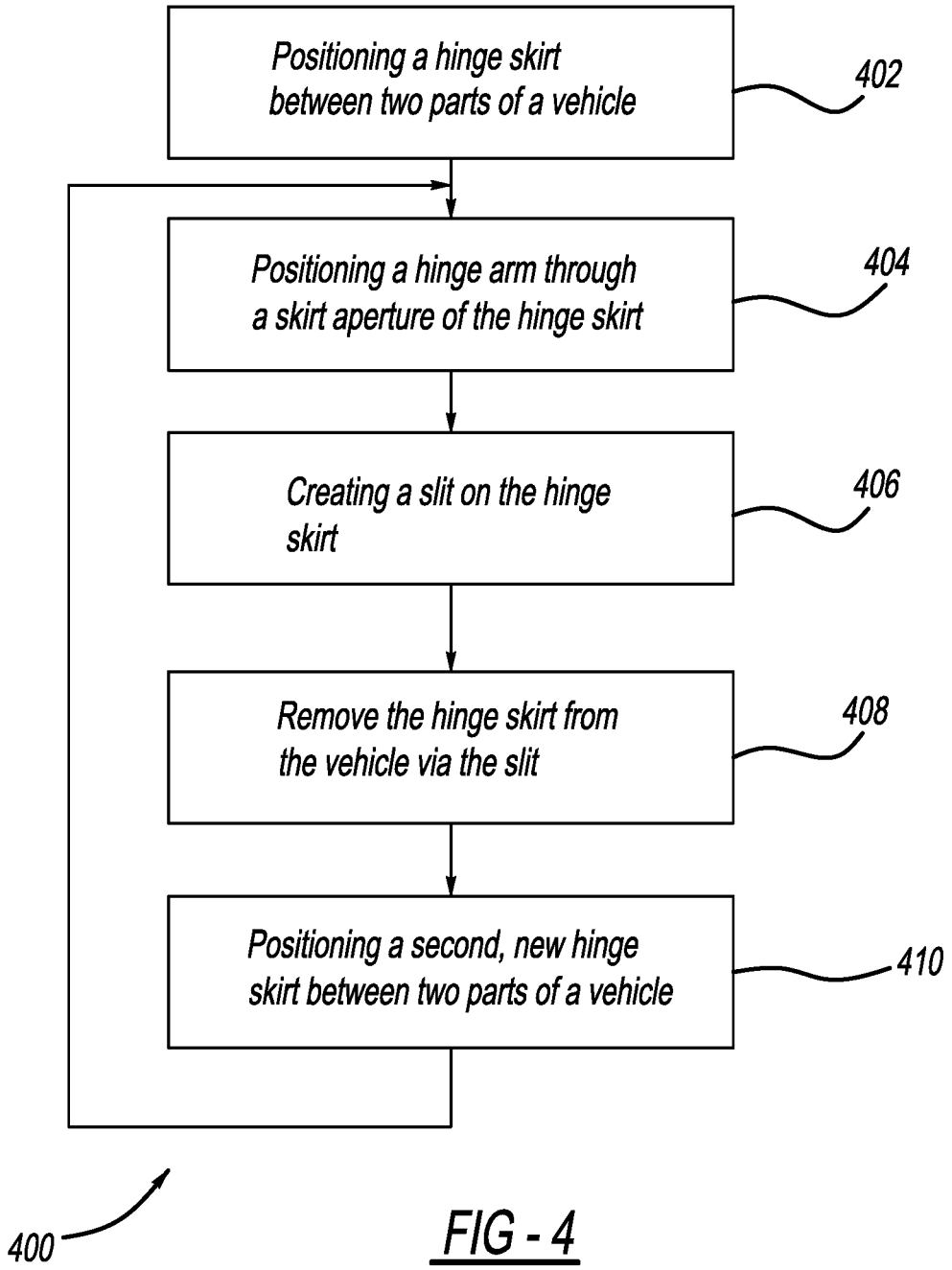
FIG. 4 illustratively depicts a flow chart for a method of operating the hinge assembly according to one or more embodiments.

Referring to FIG. 4, a method of operating the hinge assembly is generally shown at 400. The method 400 is to be detailed below in view of FIG. 2A and 2B. As detailed herein elsewhere, the method 400 is believed to be advantageous in at least providing economic efficiency and operational simplicity for connecting two vehicular parts without necessarily having to compromise on visual satisfaction of surfaces involved therein.

At step 402, the hinge skirt 140 including the skirt aperture 215 may be positioned between two vehicular parts such as the first part 110 and the second part 120. In particular, the hinge skirt 140 may be positioned on the hinge aperture 115 of the first part 110, such that a portion of the hinge skirt 140 such as the second portion 144 as illustratively depicted in FIG. 2A may be received within the hinge aperture 115. When the hinge skirt 140 is configured to include the first and second portions 142, 144 as illustratively depicted in FIG. 2A, the first portion 142 may rest upon the exterior surface 210 of the first part 110.

At step 404, the hinge arm 130 may be positioned to extend through the skirt aperture 215. Accordingly, benefits as detailed herein elsewhere may be achieved, among which is the potential of the hinge arm 130 to be movable along the direction L1 without having to compromise on visual satisfaction at or around the hinge aperture 115. In addition, the cushion 270 may further be provided to be positioned between the hinge arm 130 and the hinge skirt 140 so as to realize additional level of stability and visual appeal.

At step 406, when the hinge skirt 140 needs to be removed or replaced, the side slit 280 may be created in or provided to the hinge skirt 140 as described herein elsewhere. In particular, side walls 142*a*, 142*b* may be separated with each other to create the side slit 280. The side slit 280 may be provided to the hinge skirt 140 prior to the latter's installation to the hinge aperture 115. Alternatively, the hinge skirt 140 may be made of a material flexible enough such that a user may create the side slit 280 after the hinge skirt 140 has already been installed. One of the benefits of this configuration is that the user may replace the hinge skirt 140 with ease, as in replacement may be desirable due to everyday wear and tear.

At step 408, the hinge skirt 140 may be removed and the hinge arm 130 may pass through the side slit 280, so that the hinge skirt 140 may be removed from the hinge arm 130 via the side slit 280, and accordingly the hinge skirt 140 may be removed from the vehicle for replacement.

In certain embodiments, any of the steps 402 through 408 may be carried out in any suitable order and in any suitable combination. By way of example, step 406 may be carried out prior to the step 404. Moreover, steps 404 and 406 may be repeated prior to step 408 or step 410.

At step 410, a second or backup hinge skirt may be positioned between the first part 110 and the second part 120 similarly to step 402. Step 404 may then again be carried out to install the new hinge skirt.

Therefore, and as stated herein, a method is provided for installing, removing, and replacing the hinge assembly of a vehicle.

As stated herein, the present disclosure in one or more embodiments provides a vehicle hinge assembly and a method of operating the same. However, one skilled in the art will readily recognize from such discussion, and from the accompanying drawings and claims that various changes, modifications and variations can be made therein without departing from the true spirit and fair scope of the disclosure as defined by the following claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hinge assembly of a vehicle including first and second parts with the first part including a hinge aperture, comprising:

a hinge arm to be connected to the second part and partially received through the hinge aperture; and a hinge skirt including a skirt aperture to partially receive the hinge arm, the hinge skirt to be positioned between the first and second parts; and a stabilizer including two spaced-apart sections having an angle therebetween and a portion of the hinge arm positioned within the sections to contact the hinge skirt when the second part moves to a closed position relative to the first part.

2. The hinge assembly of claim 1, wherein the hinge skirt defines a first portion extending in a first direction and a second portion extending in a second direction different from the first direction.

3. The hinge assembly of claim 2, further comprising a cushion positioned between the second portion and the hinge arm.

4. The hinge assembly of claim 3, wherein the cushion differs in material from the second portion.

5. The hinge assembly of claim 3, wherein the cushion contacts the hinge arm.

6. The hinge assembly of claim 2, wherein the second portion is at least partially spaced apart from the hinge aperture.

7. The hinge assembly of claim 1, wherein the hinge skirt includes a side slit via which the hinge skirt is detachable from the hinge arm.

8. A hinged vehicle part assembly, comprising:

a first part including a hinge aperture;

a second part movable relative to the first part;

a hinge arm connected to the second part and being partially received through the hinge aperture; and a hinge skirt including a skirt aperture configured to partially receive the hinge arm, the hinge skirt being positioned between the first and second parts; and a stabilizer including two spaced-apart sections having an angle therebetween and a portion of the hinge arm positioned within the sections to contact the hinge skirt when the second part moves to a closed position relative to the first part.

9. The hinged vehicle part assembly of claim 8, wherein the hinge skirt contacts an exterior surface of the first part.

10. A hinged vehicle part assembly, comprising:

a first part;

a hinge arm connected to a second part, the second part movable relative to the first part;

a hinge skirt positioned between the first and second parts; and a stabilizer including two spaced-apart sections defining an angle therebetween and arranged around the hinge arm to contact the hinge skirt when the second part moves toward the first part.

* * * * *